US006562557B2

(12) United States Patent
Wagner et al.

(10) Patent No.: US 6,562,557 B2
(45) Date of Patent: May 13, 2003

(54) COLOR PHOTOGRAPHIC SILVER HALIDE MATERIAL

(75) Inventors: Klaus Wagner, Bergisch Gladbach (DE); Heinz Schütz, Leverkusen (DE); Peter Bell, Köln (DE); Lothar Endres, Bergisch Gladbach (DE); Detlev Kapitza, Leverkusen (DE); Thomas Stetzer, Langenfeld (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/908,872

(22) Filed: Jul. 19, 2001

(65) Prior Publication Data

US 2002/0031734 A1 Mar. 14, 2002

(30) Foreign Application Priority Data

Jul. 21, 2000 (DE) ..... 100 35 492
Sep. 14, 2000 (DE) ..... 100 45 368

(51) Int. Cl.[7] ..... G03C 1/46

(52) U.S. Cl. ..... 430/505; 430/502; 430/503; 430/508; 430/570; 430/572; 430/574; 430/576; 430/577; 430/581; 430/585; 430/567; 430/510

(58) Field of Search ..... 430/502, 503, 430/505, 508, 570, 572, 574, 576, 577, 581, 585, 567, 540

(56) References Cited

U.S. PATENT DOCUMENTS

| | | | | |
|---|---|---|---|---|
| 4,184,876 A | | 1/1980 | Eeles et al. | 430/505 |
| 5,169,746 A | | 12/1992 | Sasaki | 430/504 |
| 5,180,657 A | * | 1/1993 | Fukazawa et al. | 430/503 |
| 5,206,126 A | * | 4/1993 | Shimazaki et al. | 430/503 |
| 5,599,657 A | * | 2/1997 | Brennecke et al. | 430/502 |
| 5,667,956 A | * | 9/1997 | Missfeldt et al. | 430/600 |
| 5,723,280 A | | 3/1998 | Link et al. | 430/574 |
| 5,853,968 A | | 12/1998 | English et al. | 430/506 |

FOREIGN PATENT DOCUMENTS

| | | |
|---|---|---|
| EP | 434 044 | 6/1991 |
| EP | 438 049 | 7/1991 |

* cited by examiner

*Primary Examiner*—Geraldine Letscher
(74) *Attorney, Agent, or Firm*—Connolly Bove Lodge & Hutz LLP

(57) ABSTRACT

A color photographic material comprising a transparent support, at least one blue-sensitive, predominantly yellow-coupling silver halide emulsion layer, at least one green-sensitive, predominantly magenta-coupling silver halide emulsion layer (PP-1) and at least one red-sensitive, predominantly cyan-coupling silver halide emulsion layer (BG-1), characterised in that the spectral sensitivity distribution of BG-1 is characterised in that $$605 \leqq \lambda_{max} \leqq 630 \text{ nm},$$

$$0.1 \leqq \Delta \lg E_{640} \leqq 0.6 \text{ and}$$

$$1.8 \leqq \Delta \lg E_{680},$$

wherein $\lambda_{max}$ represents the wavelength at which the maximum sensitivity occurs, $\Delta \lg E_{640}$ represents the difference of the logarithmic sensitivity at $\lambda_{max}$ minus the logarithmic sensitivity at 640 nm, and $\Delta \lg E_{680}$ represents the difference of the logarithmic sensitivity at $\lambda_{max}$ minus the logarithmic sensitivity at 680 nm, and the sensitivities are determined after exposure and processing of the material at a cyan color density which is formed by coupling with developer oxidation product and which is 0.5 above the minimum density, is distinguished by its high sensitivity to light, its good color reproduction both when taking photographs in standard light and in other types of illumination such as artificial light from fluorescent lamps, its good reproduction of colors such as that of delphinium, and its high stability on storage under humid climatic conditions.

18 Claims, No Drawings

COLOR PHOTOGRAPHIC SILVER HALIDE MATERIAL

This invention relates to a colour photographic material comprising a transparent support, at least one blue-sensitive, predominantly yellow-coupling silver halide emulsion layer, at least one green-sensitive, predominantly magenta-coupling silver halide emulsion layer (PP-1) and at least one red-sensitive, predominantly cyan-coupling silver halide emulsion layer (BG-1).

It is known from EP 434 044 that the production of a coloured material which has its maximum red sensitivity within the range from 595 to 625 nm and its maximum green sensitivity within the range from 530 to 560 nm is advantageous for high colour saturation and for good reproduction of certain colours.

It is known from U.S. Pat. No. 5,169,746 that certain colours are reproduced well if the red sensitivity at 650 nm is at least 50 % less than the maximum red sensitivity, if no magenta-coloured cyan masking coupler is used at the same time.

U. S. Pat. No. 5,723,280 discloses that a high sensitivity can be attained with certain spectral sensitisers despite their maximum red sensitivity being situated at less than 640 nm. These spectral sensitisers are trimethine cyanine dyes comprising a substituted benzoxazole and a substituted benzthiazole or benzselenazole radical, which contain a condensed phenyl radical and which comprise a 2-sulphoethyl group on a nitrogen atom. According to the teaching of U.S. Pat. No. 5,853,968, similar sensitisers in combination with other red sensitisers also result in improved colour reproduction and in better bleachability.

It is also mentioned in the above patent specifications that the claimed materials can contain filter layers comprising magenta dyes for example. Advantageous inter-actions or a preferred arrangement within the material are not disclosed in connection with these additives, however.

The starting point for each of the aforementioned patent specifications was the discrepancy, which has long been known, between the red sensitivity of the human eye and the red sensitivity of colour films, which is shifted bathochromically with respect to the human eye. The teaching which is emphasised therein is to effect a hypsochromatic shift of the sensitisation to red as far as possible until it corresponds to the red sensitivity distribution of the human eye.

However, because the processing of an exposed film to form a coloured image proceeds differently from the colour processing phenomena in the brain, an accurate adjustment of the sensitisation in the film to match the spectral sensitivity distribution of the human eye is not the solution to all colour reproduction problems. In particular, the colour adaptation of the eye cannot be adjusted thus, which gives rise to more or less pronounced colour casts depending on the ambient illumination. Thus the materials according to the prior art exhibit too high a level of colour when standard daylight is replaced by light of a different colour temperature. In particular, these prior art materials are unsatisfactory for taking photographs in artificial light from fluorescent lamps.

Another disadvantage of these known materials is their sensitivity to short wave red light, which is still unsatisfactory.

Moreover, the colour reproduction according to the prior art is still unsatisfactory for certain colours of flowers, e.g. delphinium, and for some textile colours. All colours are affected which exhibit a significant absorption in the long wave red region or in the infrared region.

Furthermore, no success has been achieved with these prior art materials in fulfilling the severe demands imposed on the stability of modem colour photographic silver halide materials. For the production of all-round colour films in particular, which should be capable of being used worldwide, the stability under humid climatic conditions is still unsatisfactory.

The underlying object of the present invention was thus to identify a colour photo-graphic silver halide material with a high sensitivity to light, which in addition to its colour reproduction in standard light also gives good results in other types of illumination, particularly in the artificial light from fluorescent lamps, which reproduces colours such as that of the delphinium without distortion, and which exhibits high stability on storage under humid climatic conditions.

Surprisingly, it has now been found that this object can be achieved if the spectral sensitivity distribution of the cyan layer in a colour photographic material is adjusted so that the sensitivity maximum is situated in the vicinity of 620 nm, and the sensitivity in the longer wavelength region first of all falls only slightly up to 640 nm and then falls steeply up to 680 nm. This condition is fulfilled by a maximum of unsymmetrical width or preferably by a secondary maximum or by a pronounced shoulder in the spectral sensitivity distribution, wherein the wider part of the red sensitivity curve, the secondary maximum, or the shoulder, is shifted batho-chromatically in relation to the maximum. Expressed numerically, the sensitivity at 640 nm has to be less by a certain extent than the maximum sensitivity which is shifted towards the short wave region, and the sensitivity at 680 nm has to be less by a minimum extent than the maximum sensitivity. This type of red sensitivity distribution differs considerably from the types of red sensitisation which has been used hitherto in photographic materials and from those which have been described hitherto. Surprisingly, the sensitisation according to the invention which was defined above, and which differs considerably from the sensitivity distribution of the human eye, results in better reproduction in artificial light than when the teaching of the prior art is followed.

The present invention therefore relates to a colour photographic material comprising a transparent support, at least one blue-sensitive, predominantly yellow-coupling silver halide emulsion layer, at least one green-sensitive, predominantly magenta-coupling silver halide emulsion layer (PP-1) and at least one red-sensitive, predominantly cyan-coupling silver halide emulsion layer (BG-1), characterised in that the spectral sensitivity distribution of BG-1 is characterised in that $$605 \leqq \lambda_{max} \leqq 630 \text{ nm},$$

$$0.1 \leqq \Delta \lg E_{640} \leqq 0.6 \text{ and}$$

$$1.8 \leqq \Delta \lg E_{680},$$

wherein $\lambda_{max}$ represents the wavelength at which the maximum sensitivity occurs, $\Delta \lg E_{640}$ represents the difference of the logarithmic sensitivity at $\lambda_{max}$ minus the logarithmic sensitivity at 640 nm, and $\Delta \lg E_{680}$ represents the difference of the logarithmic sensitivity at $\lambda_{max}$ minus the logarithmic sensitivity at 680 nm, and the sensitivities are determined after exposure and processing of the material at a cyan colour density which is formed by coupling with developer oxidation product and which is 0.5 above the minimum density.

The logarithmic spectral sensitivities are obtained from the spectrogram of the photographic material by plotting logarithmic sensitivity against wavelength, wherein it has proved most useful to measure the sensitivities at a density of 0.5 greater than $D_{Min}$. For this purpose, the test material is processed according to standards or by methods provided for the material.

The strong dependence of the reproduction in artificial light on the shape of the spectrum was particularly surprising. If a departure is made from the aforementioned ranges for $\lambda_{max}$ and for $\Delta lgE_{640}$, a significant green cast is obtained for exposures made in the light from fluorescent lamps. Particularly good results, even with regard to delphinium reproduction, are achieved if $$610 \leqq \lambda_{max} \leqq 625 \text{ nm},$$

$$0.2 \leqq \Delta lgE_{640} \leqq 0.5 \text{ and}$$

$$2.0 \leqq \Delta lgE_{680}.$$

PP-1 is preferably further from the support than is BG-1, and at least one green-absorbing dye is contained in BG-1 or in a layer which is situated between PP-1 and BG-1. The at least one green-absorbing dye is most preferably contained in a layer which is situated between PP-1 and BG-1. Even though the green-absorbing dye, the absorption of which always has a certain half-width value, also absorbs part of the light in this arrangement to which the short wave red-sensitised BG-1 layer is sensitive, it has surprisingly been found that there is no significant loss in sensitivity due to a dye such as this, despite the aforementioned layer arrangement. It was also surprising that the colour reproduction in artificial light illumination, particularly in the light from a fluorescent tube, was sometimes further improved, or at least remained just as good, even though, due to the dye, the spectral sensitisation of the film exhibited a clear separation between the red- and green-sensitive layers and thus differed even more significantly from the human eye, which is characterised by a broad overlap between its red- and green-sensitive sensors. Instead, it is possible to achieve a more strongly differentiated reproduction of orange, yellow/orange and yellow/green shades due to the reduced overlap between the spectral sensitivities of BG-1 and PP-1, which results from the use according to the invention of the green-absorbing dye.

The advantages obtained are particularly pronounced, and are surprisingly associated with improved stability under humid conditions, if the at least one green-absorbing dye is the aluminium-coloured lake of aurinetricarboxylic acid.

In order to achieve the kind of red sensitisation according to the invention, it has proved to be advantageous to use a mixture of at least two red sensitisers in BG-1. It is particularly advantageous if just two sensitisers are used simultaneously. It is preferable to use $1 \cdot 10^{-4}$ to $2 \cdot 10^{-3}$, most preferably $3 \cdot 10^{-4}$ to $1{,}2 \cdot 10^{-3}$ mol sensitisers per mol silver halide, wherein each known variant of the method of addition is suitable. Spectral sensitisation is preferably effected over a period of time ranging from just before chemical sensitisation until the production of the cast melt, most preferably directly before chemical sensitisation. The sensitisers are advantageously added as a solution or as a dispersion.

In one embodiment of the invention, which is particularly advantageous for the sensitivity, at least one dye of formula I and at least one dye of formula II are contained in BG-1:

(I)

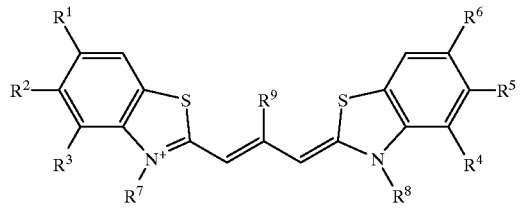

wherein the radicals $R^1$ to $R^6$ denote hydrogen, a halogen, or a cyano, methyl, tri-fluoromethyl, methoxy, aryl or hetaryl radical, or $R^1$ together with $R^2$, or $R^2$ together with $R^3$ and/or $R^4$ together with $R^5$, or $R^5$ together with $R^6$, denote the remaining members of a substituted or unsubstituted condensed-on benzene or naphthalene ring system, and the radicals $R^1$ to $R^6$, which are not part of a ring system, denote hydrogen, a halogen, or a cyano, methyl, trifluoromethyl, methoxy, aryl or hetaryl radical, $R^7$, $R^8$ denote an alkyl $Y^1O_3S$-alkylene, $Y^1O_2C$-alkylene, alkylene-$SO_2$—$NY^1$—$SO_2$-alkyl, alkylene-$SO_2$—$NY^1$—$CO_2$-alkyl, alkylene-CO—$NY^1$—$SO_2$-alkyl or alkylene-CO—$NY^1$—CO-alkyl radical, wherein the alkyl and alkylene can be further substituted, $Y^1$ denotes hydrogen or a negative charge, $R^9$ denotes hydrogen or a methyl or ethyl radical, and $M^1$ optionally denotes a counterion for charge compensation, and (II)

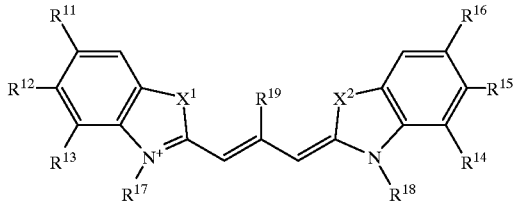

wherein $X^1$ denotes sulphur or selenium, $X^2$ denotes oxygen or N—$R^{10}$.

$R^{10}$ denotes an alkyl, $Y^1O_3S$-alkylene or $Y^1O_2C$-alkylene, wherein the alkyl and alkylene can be further substituted and comprise 1 to 6 C atoms, the radicals $R^{11}$ to $R^{16}$ denote hydrogen, a halogen, or a cyano, methyl, trifluoro-methyl, methoxy, aryl or hetaryl radical, or $R^{11}$ together with $R^{12}$, or $R^{12}$ together with $R^{13}$ and/or $R^{14}$ together with $R^{15}$, or $R^{15}$ together with $R^{16}$, denote the remaining members of a substituted or unsubstituted condensed-on benzene or naphthalene ring system and the radicals $R^{11}$ to $R^{16}$, which are not part of a ring system, denote hydrogen, a halogen, or a cyano, methyl, trifluoromethyl, methoxy, aryl or hetaryl radical, $R^{17}$, $R^{18}$ denote an alkyl $Y^1O_3S$-alkylene, $Y^1O_2C$-alkylene, alkylene-$SO_2$—$NY^1$—$SO_2$-alkyl, alkylene-$SO_2$—$NY^1$—CO-alkyl, alkylene-CO—$NY^1$—$SO^2$-alkyl or alkylene-CO—$NY^1$—CO-alkyl radical, wherein the alkyl and alkylene can be further substituted, $R^{19}$ denotes hydrogen or a methyl or ethyl radical, and $M^2$ optionally denotes a counterion for charge compensation.

In a test of spectral sensitisers, some particularly preferably structural features with regard to spectral sensitivity were identified, and are listed below.

It is advantageous if the alkyl and alkylene groups of $R^7$, $R^8$, $R^{17}$ and $R^{18}$ contain 1 to 6 C atoms, and it is particularly advantageous if they contain 3 to 6 C atoms.

In a further advantageous embodiment, at least one of the substituents $R^1$ to $R^6$ denotes chlorine. It is particularly preferred if $R^2$ and $R^5$ denote chlorine and $R^1$, $R^3$, $R^4$ and $R^6$ denote hydrogen.

It is preferable if $X^2$ is oxygen. In one particularly preferred embodiment, $X^1$ denotes selenium. The best results are obtained when $X^1$ is selenium and $X^2$ is oxygen.

In one preferred embodiment, $R^{12}$ together with $R^{13}$ denotes the remaining members of a substituted or unsubstituted condensed-on benzene ring system, and $R^{11}$ denotes hydrogen and/or $R^{14}$ together with $R^{15}$ denotes the remaining members of a substituted or unsubstituted condensed-on benzene ring system and $R^{16}$ denotes hydrogen.

It is also advantageous if $R^{15}$ denotes chlorine, cyano, methyl, trifluoromethyl, phenyl, thienyl, benzthienyl or pyrrolyl, and $R^{16}$ denotes H, chlorine or methyl.

In another preferred embodiment, $R^{11}$ denotes H, methyl or methoxy, and $R^{12}$ denotes chlorine, methyl or methoxy.

Particularly suitable compounds of formulae I und II are listed below:

I-1

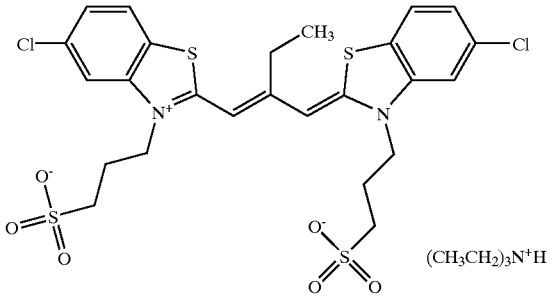

I-2

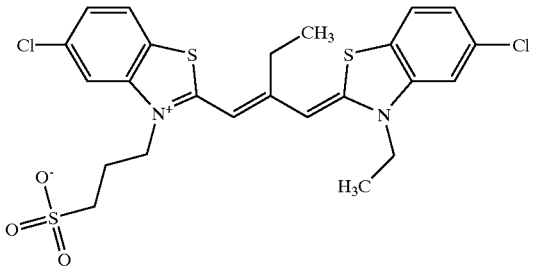

-continued

I-3

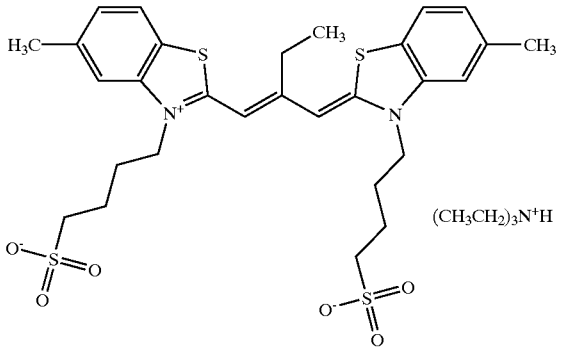

I-4

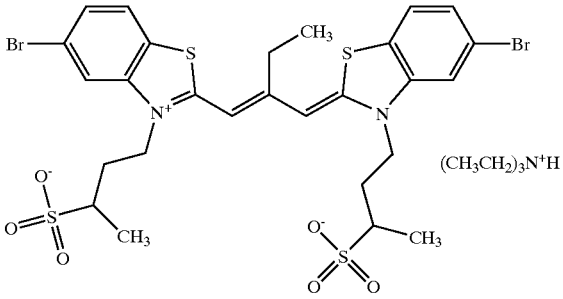

I-5

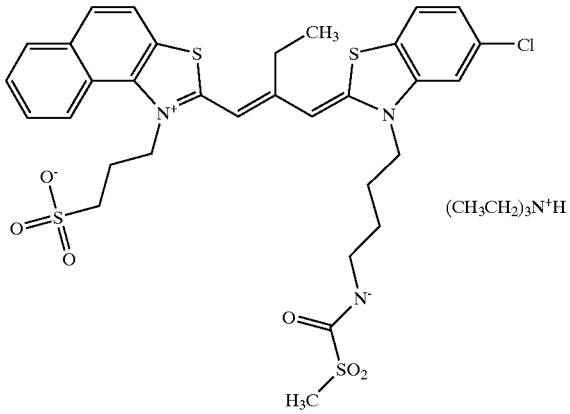

I-6

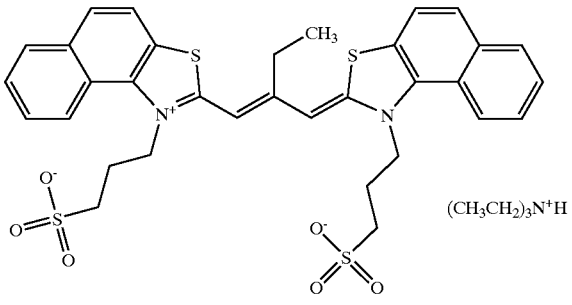

-continued
II-1
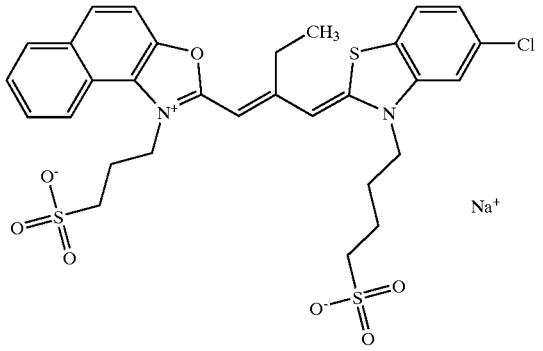
II-2
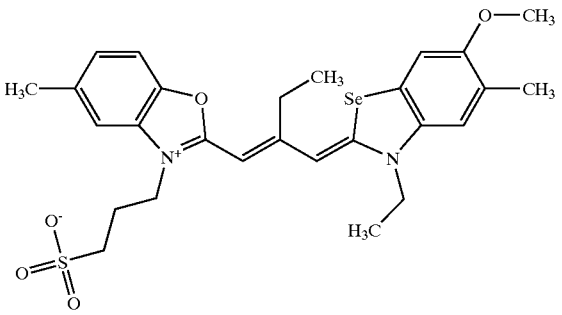
II-3
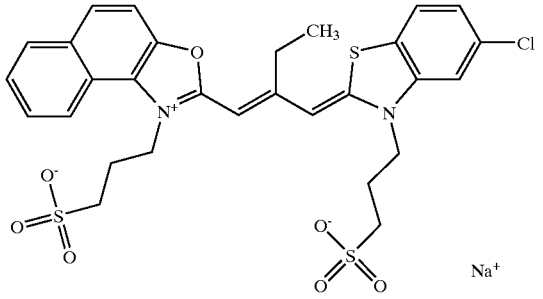
II-4
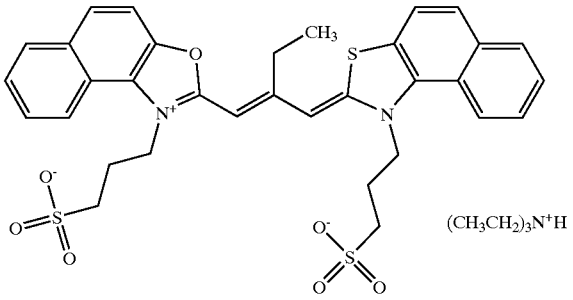
-continued
II-5
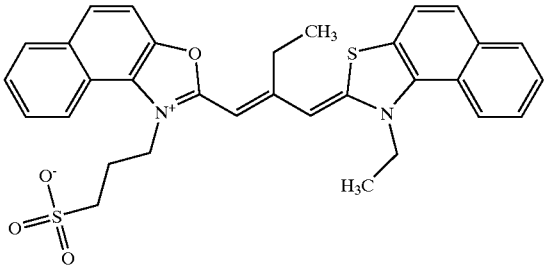
II-6
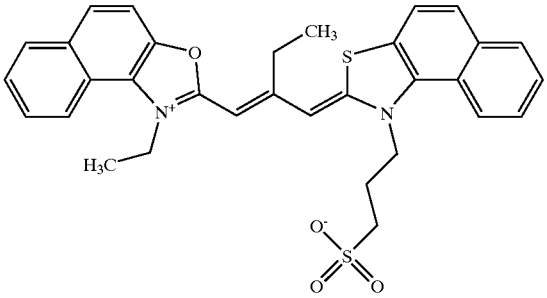
II-7
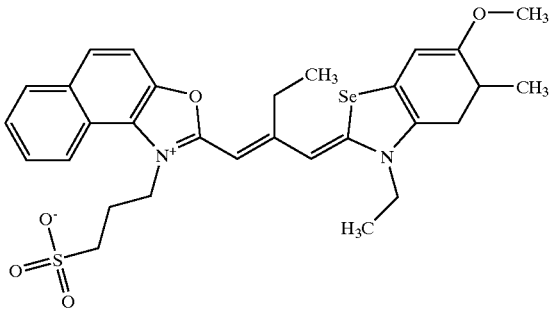
II-8
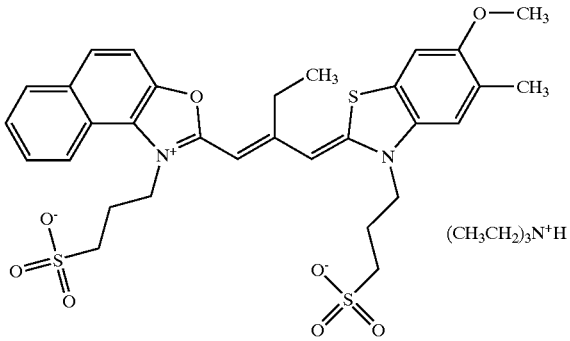

-continued
II-9
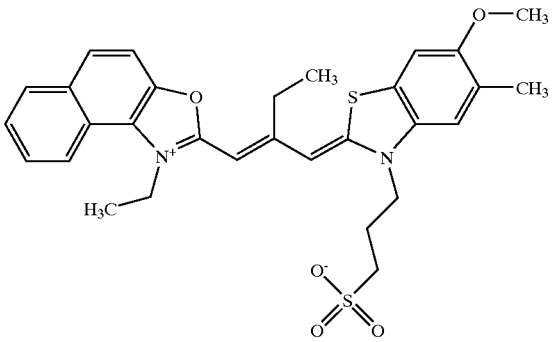
II-10
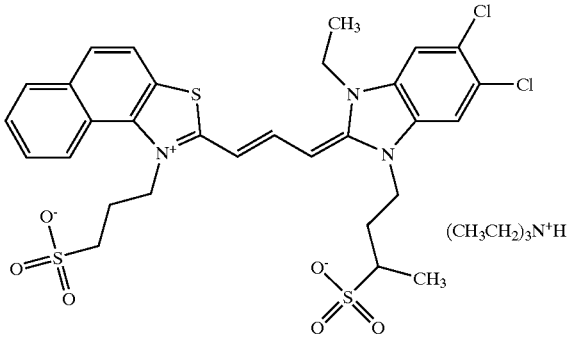
II-11
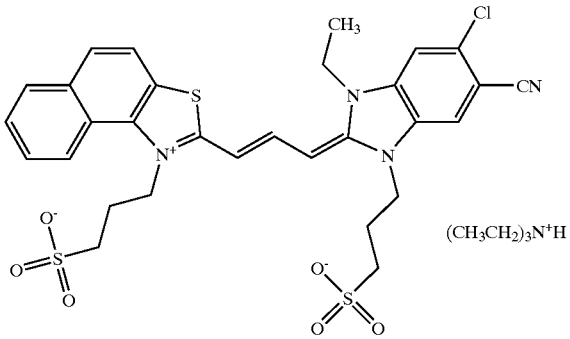
II-12
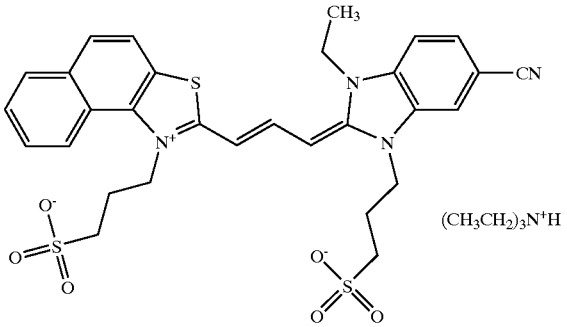
-continued
II-13
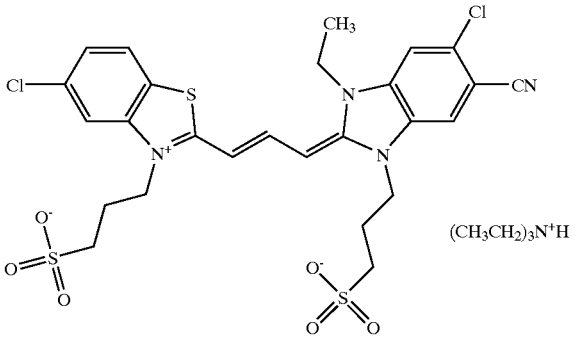
II-14
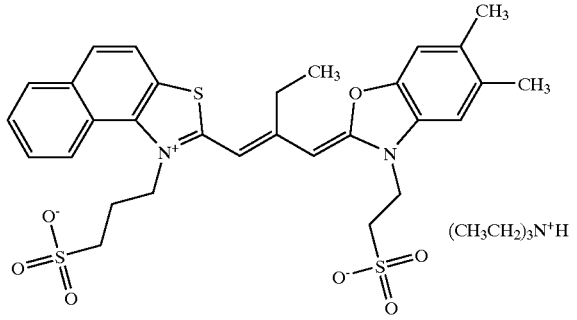
II-15
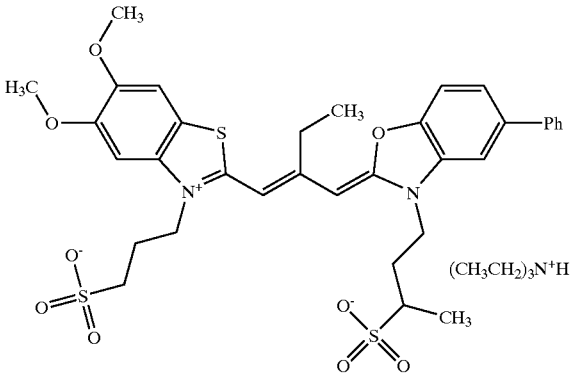
II-16
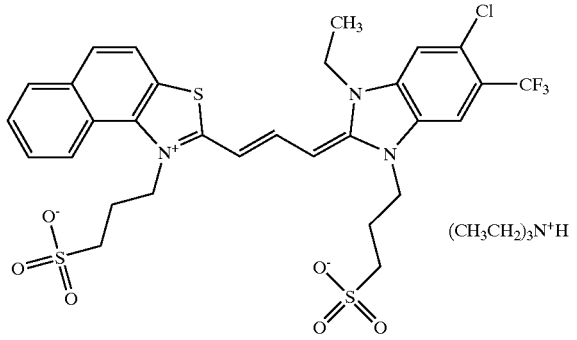

-continued

II-17

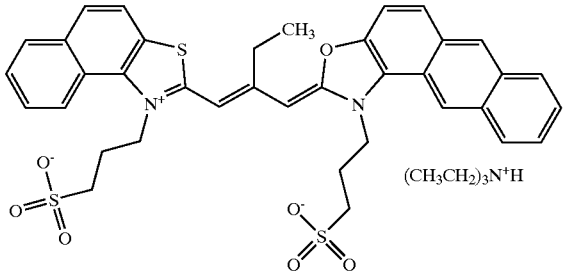

II-18

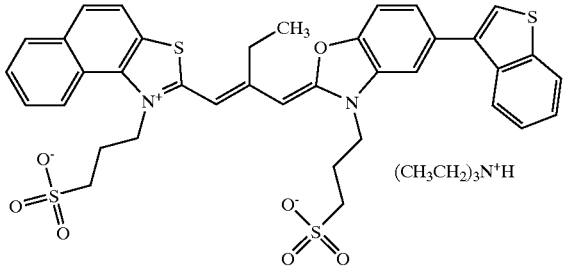

II-19

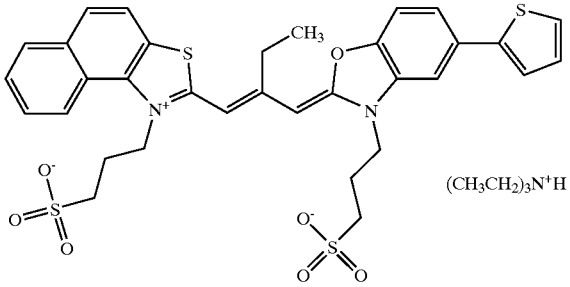

II-20

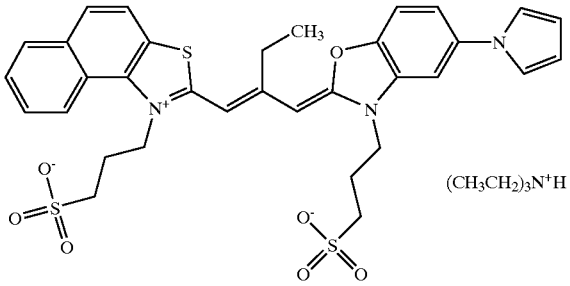

II-21

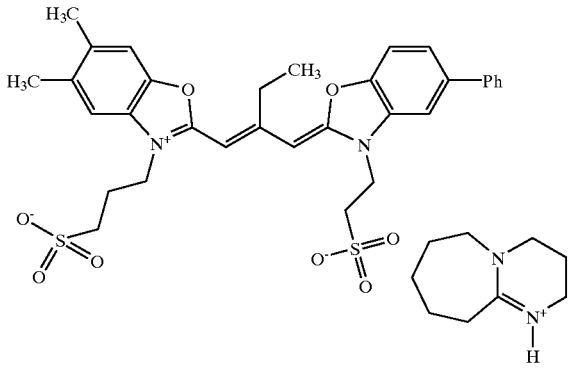

If more than one red sensitiser is used, the form of the spectrogram according to the invention can be altered via the mixture ratio of the sensitisers. If a long wave sensitiser and a short wave sensitiser corresponding to formulae I and II are used, the preferred molar mixture ratios range from 1:2 to 1:9, expressed in each case as parts of sensitiser of formula I to parts of sensitiser of formula II. Mixture ratios ranging from 1:2.5 to 1:6 are particularly preferred. The desired result can be obtained using any sequence of addition. It is particularly preferred if the sensitiser of formula II is added first, followed by the sensitiser of formula I.

It is advantageous if BG-1 contains at least one silver bromide-iodide emulsion or silver bromide-chloride-iodide emulsion which has an iodide content of 0.5 to 40 mol % and a chloride content of 0 to 10 mol %, and at least 50% of which, with respect to the projected area, consists of tabular grains with an aspect ratio of at least 4, particularly if the tabular grains have a structured arrangement comprising a core, an inner zone and an outer zone and the inner zone contains at least one iodide-rich crystal zone which has an iodide content of 2 to 45 mol % and which with respect to the silver makes up 10 to 70 mol % the crystals and has a higher iodide content than the core and the outer zone.

In a further preferred embodiment, the invention relates to a colour photographic material which contains at least two blue-sensitive, predominantly yellow-coupling silver halide emulsion layers, at least two green-sensitive, predominantly magenta-coupling silver halide emulsion layers (PP-1 and PP-2) and at least two red-sensitive, predominantly cyan-coupling silver halide emulsion layers (BG-1 and BG-2), each of which has a different sensitivity, and that the spectral sensitivity distribution of BG-2 is also characterised in that $$605 \leqq \lambda_{max} \leqq 630 \text{ nm},$$

$$0.1 \leqq \Delta \lg E_{640} \leqq 0.6, \text{ and}$$

$$1.8 \leqq \Delta \lg E_{680}.$$

It has surprisingly been found that by using the same type of spectral sensitisation according to the invention in a material which comprises two layers in each colour stack, the advantages of the invention compared with a corresponding single layer material are considerably increased.

The colour photographic material most preferably contains at least two blue-sensitive, predominantly yellow-coupling silver halide emulsion layers, at least three green-sensitive, predominantly magenta-coupling silver halide emulsion layers (PP-1, PP-2 and PP-3) and at least three red-sensitive, predominantly cyan-coupling silver halide emulsion layers (BG-1, BG-2 and BG-3), each with a different sensitivity, wherein the spectral sensitivity distribution of BG-1, BG-2 and BG-3 is characterised in that $$605 \leqq \lambda_{max} \leqq 630 \text{ nm},$$

$$0.1 \leqq \Delta \lg E_{640} \leqq 0.6, \text{ and}$$

$$1.8 \leqq \Delta \lg E_{680}.$$

Surprisingly, by using the same type of spectral sensitisation according to the invention in a material which comprises three layers in the magenta and cyan colour stacks at least, the advantages of the invention compared with a corresponding two-layer material are increased considerably further.

Examples of colour photographic materials include colour negative films, colour reversal films, colour positive films, colour photographic paper, colour reversal photographic paper, and colour-sensitive materials for the colour diffusion transfer process or the silver halide bleaching process. Reviews are given in Research Disclosure 37038 (1995) and in Research Disclosure 38957 (1996).

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Color photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Color photographic films such as colour negative films and colour reversal films comprise, in the following sequence on their support: 2 or 3 red-sensitive, cyan-coupling silver halide emulsion layers, 2 or 3 green-sensitive, magenta coupling silver halide emulsion layers, and 2 or 3 blue-sensitive, yellow-coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part XI (1996), page 624.

Color photographic paper, which as a rule is less sensitive to light than is colour photographic film, usually comprises the following layers on the support, in the following sequence: a blue-sensitive, yellow-coupling silver halide emulsion layer, a green-sensitive, magenta coupling silver halide emulsion layer, and a red-sensitive, cyan-coupling silver halide emulsion layer. The yellow filter layer can be omitted.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are binders, the silver halide grains and colour couplers.

Information on suitable binders is given in Research Disclosure 37254, Part 2 (1995), page 286, and in Research Disclosure 38957, Part IIa (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part VA (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mole % AgBr, or silver chloride-bromide emulsions comprising more than 95 mole % AgCl.

Information on colour couplers is to be found in Research Disclosure 37254, Part 4 (1995), page 288, in Research Disclosure 37038, Part II (1995), page 80, and in Research Disclosure 38957, Part XB (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part X.C (1996), page 618.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part X.D (1996), page 621 et seq.

The photographic material may additionally contain compounds which absorb TV light, brighteners, spacers, filter dyes, formalin scavengers, light stabilisers, anti-oxidants, $D_{Min}$ dyes, plasticisers (latices), biocides, additives for improving the dye-, coupler- and white stability and for reducing colour fogging and for reducing yellowing, and other substances. Suitable compounds are given in Research Disclosure 37254, Part 8 (1995), page 292, in Research Disclosure 37038, Parts IV, V, VI, VII, X, XI and XIII (1995), pages 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part II.B (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996) page 630 et seq., together with examples of materials.

EXAMPLES

In order to produce a colour photographic recording material for colour negative colour development, melts which were differently sensitised to red were first prepared as described below and were used in the 2nd (low red-sensitivity partial layer), 3rd (medium red-sensitivity partial layer) and 4th layer (high red-sensitivity partial layer) of this material.

Sensitisation of the Emulsions for the Layer Structure Examples.

REM 1.1 to REM 1.13

An Ag(Br,I) emulsion with an iodide content of 4 mol %, an average grain diameter of 0.42 μm and a tabular grain habit with an aspect ratio of 5 was used for each 2nd layer of the layer structure, and is hereinafter called EM1.

In order to produce melts REM 1.1 to REM 1.13, emulsion EM1 was melted at 40° C. and was spectrally sensitised for 25 minutes with solutions of the sensitiser dyes listed in Table 1. For this purpose, the dyes were added in the sequence as listed from left to right in Table 1, and each addition of a sensitiser was followed by a digestion interval of 5 minutes. This procedure was followed by a digestion interval which extended beyond the remaining time of the 25 minutes. The amount of sensitisers used is given in Table 1.

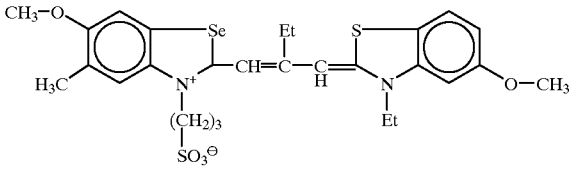

The melts were then heated to 46° C. over 9 minutes, and were chemically ripened to the optimum sensitivity by adding 7 μmol tetrachloroauric acid per mol Ag, 1200 μmol potassium rhodanide per mol Ag and 38 μmol sodium thiosulphate per mol Ag, and were subsequently stabilised with 4 mmol 4-hydroxy-6-methyl-1,3,3a,7-tetraazaindene per mol Ag.

REM 2.1 to REM 2.13

An Ag(Br,I) emulsion with an iodide content of 4.8 mol %, an average grain diameter of 0.58 μm and a tabular grain habit with an aspect ratio of 6 was used for each 3rd layer of the layer structure, and is hereinafter called EM2.

In order to produce melts REM 2.1 to REM 2.13, emulsion EM2 was melted at 40° C. and was spectrally sensitised for 25 minutes with solutions of the sensitiser dyes listed in Table 1. For this purpose, the dyes were added in the sequence as listed from left to right in Table 1, and each addition of a sensitiser was followed by a digestion interval of 5 minutes. This procedure was followed by a digestion interval which extended beyond the remaining time of the 25 minutes. The amount of sensitisers used is given in Table 1.

The melts were then heated to 46° C. over 9 minutes, and were chemically ripened to the optimum sensitivity by adding 22 μmol sodium thiosulphate per mol Ag, 3.6 μmol tetrachloroauric acid per mol Ag, and 670 μmol potassium rhodanide per mol Ag and were subsequently stabilised with 4 mmol 4-hydroxy-6-methyl-1,3,3a,7-tetraazaindene per mol Ag.

REM 3.1 to REM 3.13

An Ag(Br,I) emulsion with an iodide content of 4.5 mol %, an average grain diameter of 0.72 μm and a tabular grain habit with an aspect ratio of 8 was used for each 4th layer of the layer structure, and is hereinafter called EM3.

In order to produce melts REM 3.1 to REM 3.13, emulsion EM3 was melted at 40° C. and was spectrally sensitised for 25 minutes with solutions of the sensitiser dyes listed in Table 1. For this purpose, the dyes were added in the sequence as listed from left to right in Table 1, and each addition of a sensitiser was followed by a digestion interval of 5 minutes. This procedure was followed by a digestion interval which extended beyond the remaining time of the 25 minutes. The amount of sensitisers used is given in Table 1.

The melts were then heated to 46° C. over 9 minutes, and were chemically ripened to the optimum sensitivity by adding 11 μmol sodium thiosulphate per mol Ag, 2 μmol tetrachloroauric acid per mol Ag, and 350 μmol potassium rhodanide per mol Ag, and were subsequently stabilised with 4 mmol 4-hydroxy-6-methyl-1,3,3a,7-tetra-azaindene per mol Ag.

Layer Structure 1

Color photographic recording material 1 for colour negative colour development was produced by depositing the following layers in the given sequence on a transparent film base made of cellulose triacetate. The quantitative data are given with respect to 1 $m^2$ in each case. The corresponding amounts of $AgNO_3$ are quoted for silver halide deposition.

1st layer (anti-halo layer)

| | | |
|---|---|---|
| 0.3 | g | black colloidal silver |
| 1.2 | g | gelatine |
| 0.3 | g | UV absorber UV 1 |
| 0.2 | g | DOP (developer oxidation product) - scavenger SC-1 |
| 0.02 | g | tricresyl phosphate (TCP) |

2nd layer (low red-sensitivity layer)

| | | |
|---|---|---|
| 0.7 | g | $AgNO_3$ of melt REM 1.1, spectrally sensitised to red |
| 1 | g | gelatine |
| 0.35 | g | colourless coupler C-1 |
| 0.05 | g | coloured coupler RC-1 |
| 0.03 | g | coloured coupler YC-1 |
| 0.36 | g | TCP |

3rd layer (medium red-sensitivity layer)

| | | |
|---|---|---|
| 0.8 | g | $AgNO_3$ of melt REM 2.1, spectrally sensitised to red |
| 0.6 | g | gelatine |
| 0.15 | g | colourless coupler C-2 |
| 0.03 | g | coloured coupler RC-1 |
| 0.02 | g | DIR coupler D-1 |
| 0.18 | g | TCP |

4th layer (high red-sensitivity layer)

| | | |
|---|---|---|
| 1 | g | $AgNO_3$ of melt REM 3.1, spectrally sensitised to red |
| 1 | g | gelatine |
| 0.1 | g | colourless coupler C-2 |
| 0.005 | g | DIR coupler D-2 |
| 0.11 | g | TCP |

5th layer (intermediate layer)

| | | |
|---|---|---|
| 0.8 | g | gelatine |
| 0.07 | g | DOP scavenger SC-2 |

6th layer (low green-sensitivity layer)

| | | |
|---|---|---|
| 0.7 | g | $AgNO_3$ of an AgBrI emulsion, spectrally sensitised to green, 4 mol % iodide, average grain diameter 0.35 μm |
| 0.8 | g | gelatine |
| 0.22 | g | colourless coupler M-1 |
| 0.065 | g | coloured coupler YM-1 |

-continued

| | | |
|---|---|---|
| 0.02 | g | DIR coupler D-3 |
| 0.2 | g | TCP |

7th layer (medium green-sensitivity layer)

| | | |
|---|---|---|
| 0.9 | g | $AgNO_3$ of an AgBrI emulsion, spectrally sensitised to green, 4 mol % iodide, average grain diameter 0.50 μm |
| 1 | g | gelatine |
| 0.16 | g | colourless coupler M-1 |
| 0.04 | g | coloured coupler YM-1 |
| 0.015 | g | DIR coupler D-4 |
| 0.14 | g | TCP |

8th layer (high green-sensitivity layer)

| | | |
|---|---|---|
| 0.6 | g | $AgNO_3$ of an AgBrI emulsion, spectrally sensitised to green, 6 mol % iodide, average grain diameter 0.70 μm |
| 1.1 | g | gelatine |
| 0.05 | g | colourless coupler M-2 |
| 0.01 | g | coloured coupler YM-2 |
| 0.02 | g | DIR coupler D-5 |
| 0.08 | g | TCP |

9th layer (yellow filter layer)

| | | |
|---|---|---|
| 0.09 | g | yellow dye GF-1 |
| 1 | g | gelatine |
| 0.08 | g | DOP scavenger SC-2 |
| 0.26 | g | TCP |

10th layer (low blue-sensitivity layer)

| | | |
|---|---|---|
| 0.3 | g | $AgNO_3$ of an AgBrI emulsion, spectrally sensitised to blue, 6 mol % iodide, average grain diameter 0.44 μm |
| 0.5 | g | $AgNO_3$ of an AgBrI emulsion, spectrally sensitised to blue, 6 mol % iodide, average grain diameter 0.50 μm |
| 1.9 | g | gelatine |
| 1.1 | g | colourless coupler Y-1 |
| 0.037 | g | DIR coupler D-6 |
| 0.6 | g | TCP |

11th layer (high blue-sensitivity layer)

| | | |
|---|---|---|
| 0.6 | g | $AgNO_3$ of an AgBrI emulsion, spectrally sensitised to blue, 7 mol % iodide, average grain diameter 0.95 μm |
| 1.2 | g | gelatine |
| 0.1 | g | colourless coupler Y-1 |
| 0.006 | g | DIR coupler D-7 |
| 0.11 | g | TCP |

12th layer (micrate layer)

| | | |
|---|---|---|
| 0.1 | g | $AgNO_3$ of a micrate-AgBrI emulsion, 0.5 mol % iodide, average grain diameter 0.06 μm |
| 1 | g | gelatine |
| 0.004 | mg | $K_2[PdCl_4]$ |
| 0.4 | g | UV absorber UV 2 |
| 0.3 | g | TCP |

13th layer (protective and hardener layer)

| | | |
|---|---|---|
| 0.25 | g | gelatine |
| 0.75 | g | hardener H-1 |

After hardening, the overall layer structure had a swelling factor ≦3.5.

Substances used in layer structure 1:

UV-1

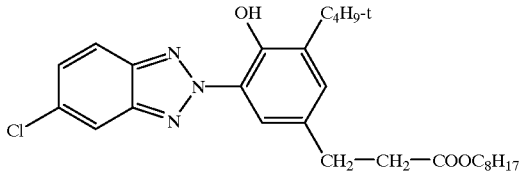

UV-2

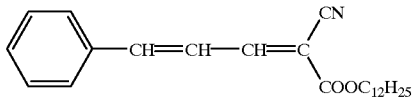

C-1

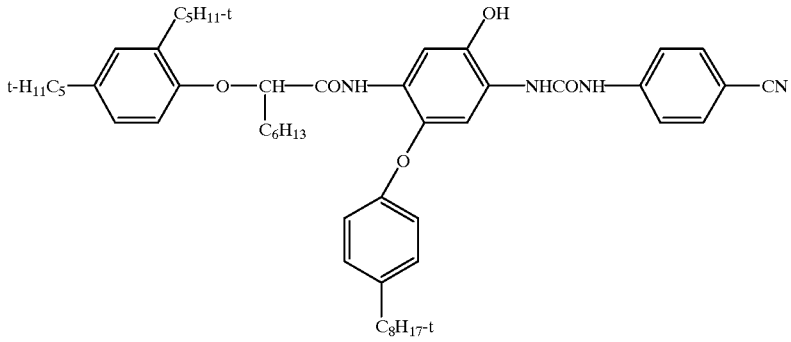

-continued
C-2
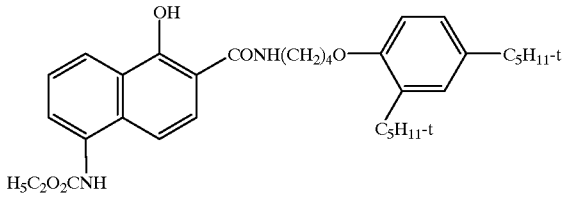
RC-1
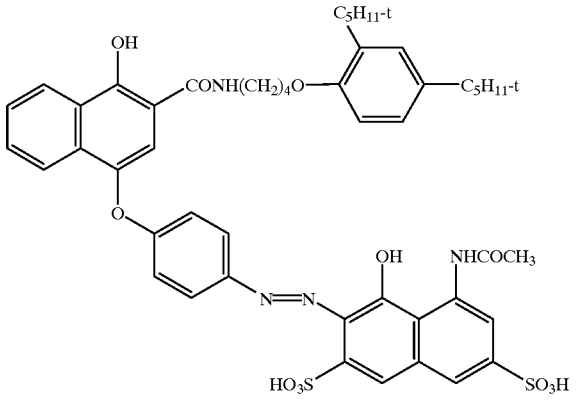
YC-1
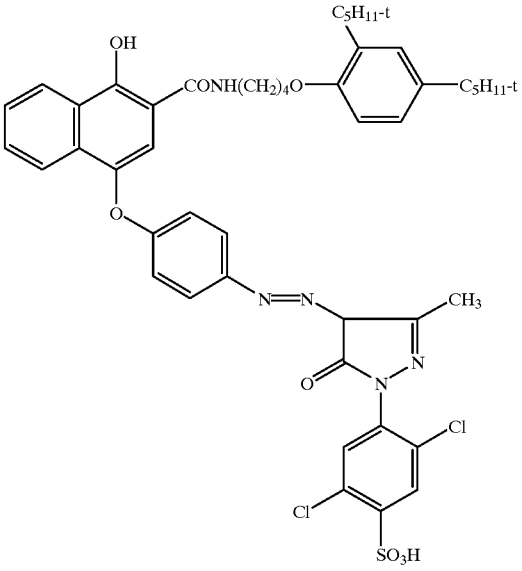
M-1
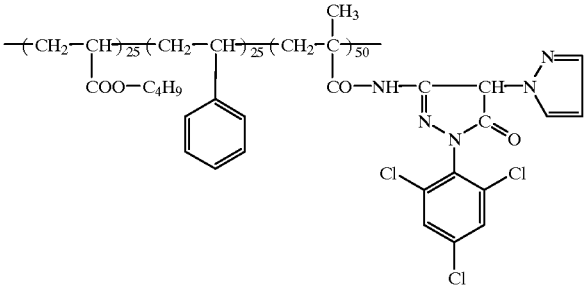
M-2
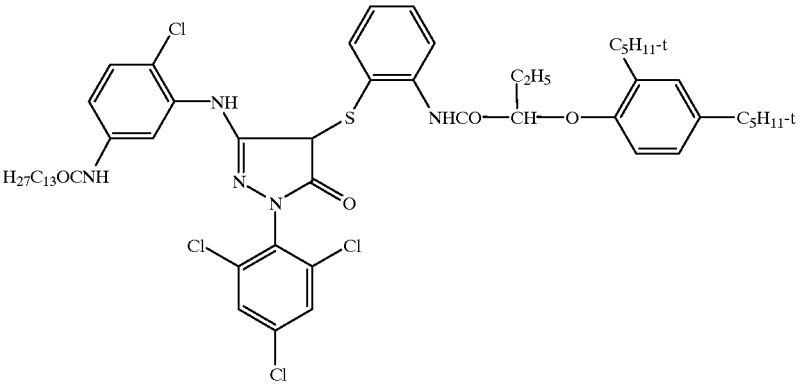

-continued
YM-1
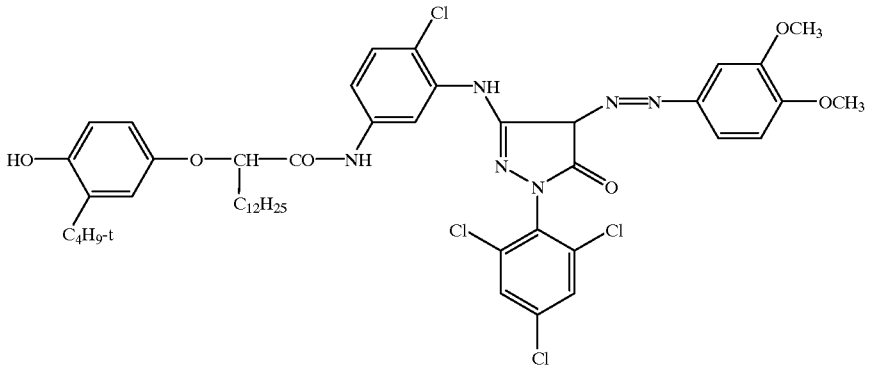
YM-2
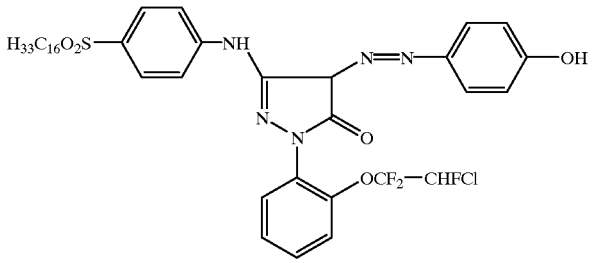
Y-1
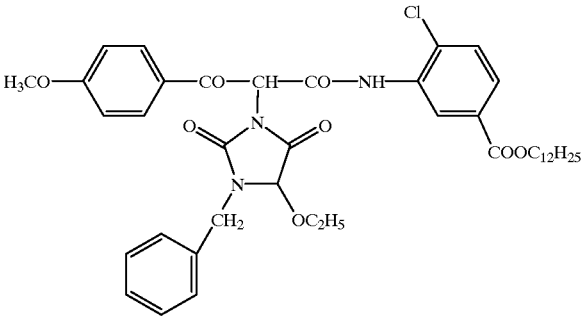
D-1
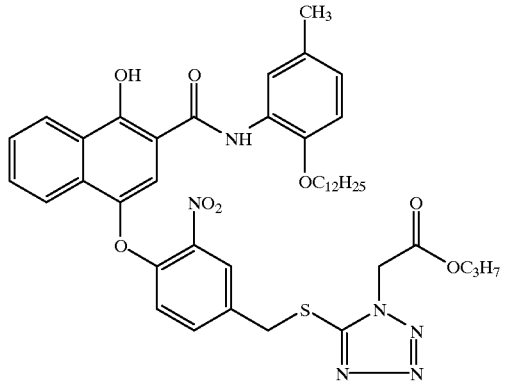
D-2
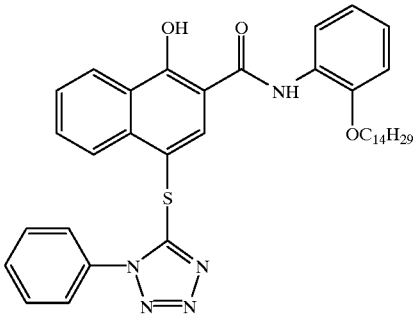
D-3
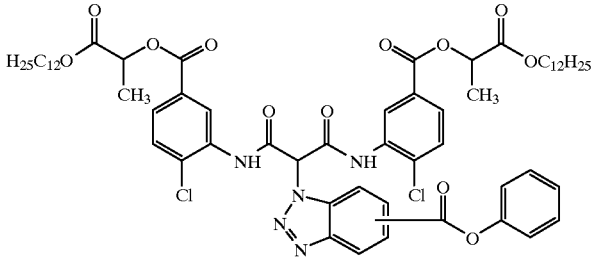
D-4
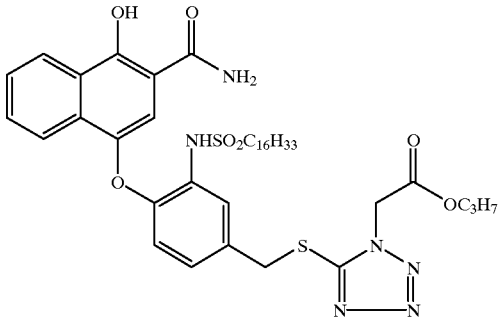

-continued

D-5

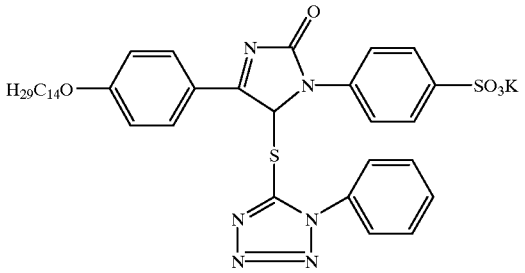

D-6

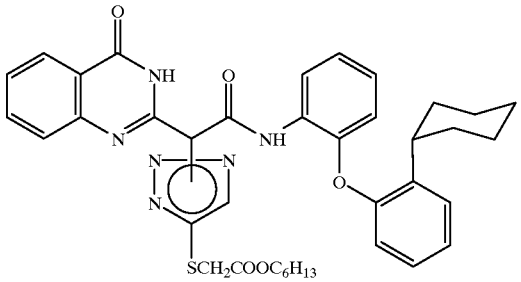

D-7

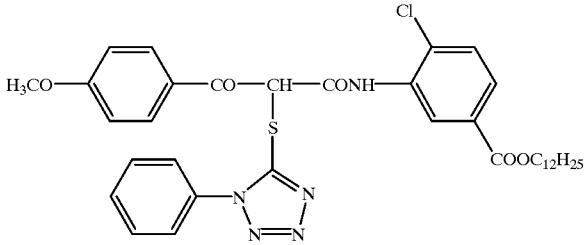

SC-1

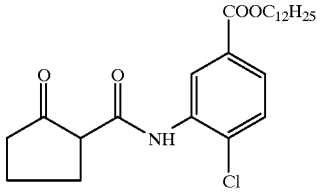

SC-2

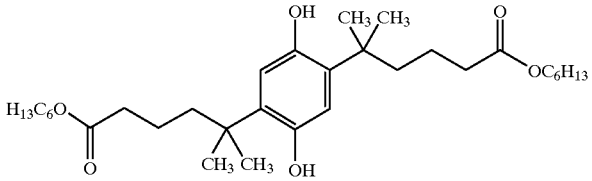

GF-1

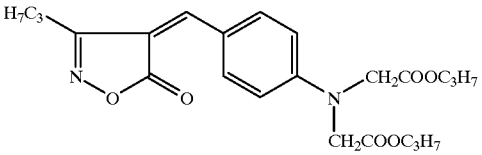

H-1

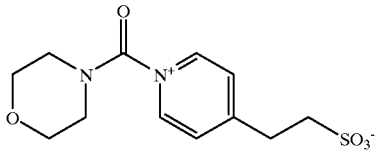

Layer Structures 2 to 13

Color photographic recording materials 2 to 13 were produced as described for layer structure 1, except that 0.7 g $AgNO_3$ of melts REM 1.2 to REM 1.13 as listed in Table 1 was used in the 2nd layer, 0.8 g $AgNO_3$ of melts REM 2.2 to REM 2.13 given in Table 1 was used in the 3rd layer, and 1 g $AgNO_3$ of melts REM 3.2 to 3.13 given in Table 1 was used in the 4th layer.

Layer Structure 14

Color photographic recording material 14 was produced as described for layer structure 1, except that 0.06 g of the aluminium-coloured lake of aurinetricarboxylic acid dispersed in gelatine was additionally used as a green filter dye in the 5th layer.

Layer Structure 15

Color photographic recording material 15 was produced as described for layer structure 2, except that 0.06 g of the aluminium-coloured lake of aurinetricarboxylic acid dispersed in gelatine was additionally used as a green filter dye in the 5th layer.

Layer Structure 16

Color photographic recording material 16 was produced as described for layer structure 3, except that 0.06 g of the aluminium-coloured lake of aurinetricarboxylic acid dispersed in gelatine was additionally used as a green filter dye in the 5th layer.

Layer Structure 17

Color photographic recording material 17 was produced as described for layer structure 4, except that 0.06 g of the aluminium-coloured lake of aurinetricarboxylic acid dispersed in gelatine was additionally used as a green filter dye in the 5th layer.

Layer Structure 18

Color photographic recording material 18 was produced as described for layer structure 7, except that 0.06 g of the aluminium-coloured lake of aurinetricarboxylic acid dispersed in gelatine was additionally used as a green filter dye in the 5th layer.

After exposure as described below, layer structures 1 to 18 were developed as described in "The British Journal of Photography", 1974, pages 597 and 598. The test results obtained are listed in Table 1.

Evaluation of the Layer Structures

Spectrograms were taken of all the materials, and after processing were recorded and printed out as a function of the logarithmic sensitivity at a density of 0.5 above $D_{Min}$ against wavelength between 580 and 720 nm. The spectrograms obtained could be classified into four different types, as shown in Table 1. Differences from material to material within each type are not relevant.

Type I: a sensitivity maximum which was shifted towards longer wavelengths in relation to the centroid of the curve. The sensitivity decreased batho-chromatically without a discernible shoulder on the spectrogram. Hypso-chromatically, there was a clearly pronounced shoulder between 600 and 610 nm.

$\lambda_{max}$=648 nm $\Delta lgE_{640}$=0.13

$\Delta lgE_{680}$=1.66

Type II: a sensitivity maximum which was shifted towards longer wavelengths in relation to the centroid of the curve. The sensitivity decreased batho-chromatically without a discernible shoulder on the spectrogram. Hypso-chromatically, there was a slightly pronounced shoulder between 610 and 620 nm.

$\lambda_{max}$=642 nm $\Delta lgE_{640}$=0.01

$\Delta lgE_{680}$=2.29

Type III: a sensitivity maximum which was shifted towards shorter wavelengths in relation to the centroid of the curve. The sensitivity decreased hypsochromatically without a discernible shoulder on the spectrogram. Bathochromatically, there was a clearly pronounced shoulder between 640 and 650 nm.

$\lambda_{max}$=620 nm $\Delta lgE_{640}$=0.17

$\Delta lgE_{680}$=2.95

Type IV: a sensitivity maximum which was shifted towards longer wavelengths in relation to the centroid of the curve. The sensitivity decreased batho-chromatically without a discernible shoulder on the spectrogram. Hypso-chromatically, there was a slightly pronounced shoulder between 600 and 610 nm.

$\lambda_{max}$=620 nm $\Delta lgE_{640}$=0.9

$\Delta lgE_{680}$=3.0

The relative fresh sensitivities (E) of the red-sensitive layer stack were determined within a period ranging from 1 to 24 hours after the production of the material and after exposure of a neutral stepped photometric absorption wedge through an L599 filter. The $D_{min}$ values, which are not listed in Table 1, were of a comparable magnitude for all the materials. The relative sensitivity data are given with respect to a density of 0.2 above $D_{Min}$, a numerical value of 100 being arbitrarily assigned to the sensitivity of recording material 1.

Materials 1 to 18 were also used to record test patterns (portrait, plants, textiles, chromaticity diagram, neutral wedge filter) in the illumination from a fluorescent tube, and the prints which were obtained by printing the negatives on colour negative photographic paper by means of an automatic printer were evaluated with regard to their green cast by 20 persons. Depending on the intensity of the green cast observed on the prints, the materials were classified into four classes (3=intense green cast, 2=average green cast, 1=slight green cast, 0=no green cast). The mean values of this evaluation, rounded up to whole numbers, are given in Table 1.

For all the materials, the colour reproduction of standard patterns comprising blue plant petals and blue textile colours was tested by means of prints which were reproduced using a red sensitisation ranging from normal to reddish (termed the "delphinium effect"). Depending on the colour reproduction of these patterns, the materials were again divided by 20 persons into three categories (much too red, too red, and correct colour reproduction). The mean values of this evaluation, rounded up to whole numbers, are given in Table 1.

All the recording materials were also subjected to storage under humid conditions for 7 days at 35° C. and at a relative atmospheric humidity of 70%, which constituted a good simulation of the storage of these film materials under humid climatic conditions. The materials which were stored in this manner were subsequently exposed and processed as described for the fresh sensitivity investigations. The differences comprising the value after storage minus the fresh value are given in Table 1 as ΔE and $\Delta D_{min}$ values.

TABLE 1

| Layer structure | Melts in the 2nd layer 3rd layer | μmol sensitiser dye per mol Ag | | | | | | Green filter in the | | Spectro-gram | Green cast when exposed in artificial | Reproduc-tion of | Stability when stored under humid conditions | |
|---|---|---|---|---|---|---|---|---|---|---|---|---|---|---|
| example No. | 4th layer | II-2 | II-3 | II-10 | I-1 | I-3 | V-1 | 5th layer | E | type | light | delphinium | ΔE | $\Delta D_{min}$ |
| 1 (comparison) | REM 1.1 | 180 | — | — | 530 | — | 90 | no | 100 | I | 3 | much too red | −0.2° | +2 |
| | REM 2.1 | 160 | — | — | 465 | — | 75 | | | | | | | |
| | REM 3.1 | 135 | — | — | 400 | — | 65 | | | | | | | |
| 2 (comparison) | REM 1.2 | 320 | — | — | 400 | — | 80 | no | 100 | II | 2 | too red | −0.4° | +4 |
| | REM 2.2 | 280 | — | — | 350 | — | 70 | | | | | | | |
| | REM 3.2 | 240 | — | — | 300 | — | 60 | | | | | | | |
| 3 (invention) | REM 1.3 | 680 | — | — | 120 | — | — | no | 100 | III | 0 | correct | −0.8° | +12 |
| | REM 2.3 | 595 | — | — | 105 | — | — | | | | | | | |
| | REM 3.3 | 510 | — | — | 90 | — | — | | | | | | | |
| 4 (invention) | REM 1.4 | 600 | — | — | 200 | — | — | no | 97 | III | 0 | correct | −0.5° | +8 |
| | REM 2.4 | 525 | — | — | 175 | — | — | | | | | | | |
| | REM 3.4 | 450 | — | — | 150 | — | — | | | | | | | |

TABLE 1-continued

| Layer structure example No. | Melts in the 2nd layer 3rd layer 4th layer | μmol sensitiser dye per mol Ag II-2 | II-3 | II-10 | I-1 | I-3 | V-1 | Green filter in the 5th layer | E | Spectro-gram type | Green cast when exposed in artificial light | Reproduc-tion of delphinium | Stability when stored under humid conditions ΔE | $\Delta D_{min}$ |
|---|---|---|---|---|---|---|---|---|---|---|---|---|---|---|
| 5 (comparison) | REM 1.5 | 320 | — | — | 480 | — | — | no | 100 | II | 2 | too red | −0.4° | +6 |
| | REM 2.5 | 280 | — | — | 420 | — | — | | | | | | | |
| | REM 3.5 | 240 | — | — | 360 | — | — | | | | | | | |
| 6 (comparison) | REM 1.6 | 160 | — | — | 640 | — | — | no | 103 | I | 2 | too red | −0.4° | +2 |
| | REM 2.6 | 140 | — | — | 560 | — | — | | | | | | | |
| | REM 3.6 | 120 | — | — | 480 | — | — | | | | | | | |
| 7 (invention) | REM 1.7 | — | 680 | — | 120 | — | — | no | 90 | III | 0 | correct | −1.0° | +15 |
| | REM 2.7 | — | 595 | — | 105 | — | — | | | | | | | |
| | REM 3.7 | — | 510 | — | 90 | — | — | | | | | | | |
| 8 (invention) | REM 1.8 | — | 560 | — | 240 | — | — | no | 90 | III | 1 | correct | −0.7° | +10 |
| | REM 2.8 | — | 490 | — | 210 | — | — | | | | | | | |
| | REM 3.8 | — | 420 | — | 180 | — | — | | | | | | | |
| 9 (comparison) | REM 1.9 | — | 320 | — | 480 | — | — | no | 92 | II | 2 | too red | −0.6° | +10 |
| | REM 2.9 | — | 280 | — | 420 | — | — | | | | | | | |
| | REM 3.9 | — | 240 | — | 360 | — | — | | | | | | | |
| 10 (comparison) | REM 1.10 | — | 160 | — | 640 | — | — | no | 95 | I | 2 | too red | −0.5° | +8 |
| | REM 2.10 | — | 140 | — | 560 | — | — | | | | | | | |
| | REM 3.10 | — | 120 | — | 480 | — | — | | | | | | | |
| 11 (comparison) | REM 1.11 | — | — | 720 | — | 80 | — | no | 75 | IV | 1 | correct | −1.4° | +25 |
| | REM 2.11 | — | — | 635 | — | 65 | — | | | | | | | |
| | REM 3.11 | — | — | 540 | — | 60 | — | | | | | | | |
| 12 (comparison) | REM 1.12 | — | — | 320 | — | 480 | — | no | 85 | II | 2 | too red | −1.1° | +18 |
| | REM 2.12 | — | — | 280 | — | 420 | — | | | | | | | |
| | REM 3.12 | — | — | 240 | — | 360 | — | | | | | | | |
| 13 (comparison) | REM 1.13 | — | — | 160 | — | 640 | — | no | 89 | I | 3 | much too red | −0.7° | +12 |
| | REM 2.13 | — | — | 140 | — | 560 | — | | | | | | | |
| | REM 3.13 | — | — | 120 | — | 480 | — | | | | | | | |
| 14 (comparison) | melts as in layer structure of Example 1 | | | | | | | yes | 100 | I | 3 | much too red | −0.3° | +2 |
| 15 (comparison) | melts as in layer structure of Example 2 | | | | | | | yes | 100 | II | 2 | too red | −0.3° | +3 |
| 16 (invention) | melts as in layer structure of Example 3 | | | | | | | yes | 98 | III | 0 | correct | −0.1° | +3 |
| 17 (invention) | melts as in layer structure of Example 4 | | | | | | | yes | 97 | III | 0 | correct | −0.2° | +2 |
| 18 (invention) | melts as in layer structure of Example 7 | | | | | | | yes | 93 | III | 0 | correct | −0.3° | +3 |

It is clear from the classification of the delphinium effect in Table 1 that it is only materials with a spectrogram of Types III or IV which also result in the correct colour reproduction of these blue plant petals and textile dyes.

It was completely surprising, however, that it was only the materials which were produced according to the invention and which had a spectrum of Type III which also gave neutral image results when exposed in artificial light. Despite its shorter wavelength sensitisation and its spectrogram of Type IV, material 11 resulted in a green cast when photographs were taken in the light from a fluorescent tube. Moreover, the sensitivity of this material was too low.

It can also be seen from Table 1 that by selecting the preferred sensitisers the losses of sensitivity ranged from very slight to none, despite the shorter wavelength sensitisation according to the invention. The less preferred sensitisers can be recognised by the fact that the sensitivity exhibits a stronger decrease the more the sensitiser mixture ratio is changed in the direction of producing advantageous spectra. This is shown, for example, by materials 10 and 9 listed after material 8, where the loss in sensitivity for material 8 is still just acceptable.

Table 1 shows that when stored under humid conditions, the sensitiser dye mixtures which are necessary for the most favourable colour reproduction in each case can give rise to somewhat greater losses in sensitivity and somewhat greater increases in fogging during storage such as this. Surprisingly, the green filter which was used in the 5th layer above the red-sensitivity layer and which comprised a dispersion of the aluminium-coloured lake of aurinetricarboxylic acid in aqueous gelatine was clearly capable of counteracting this effect, and resulted in very good stability under humid conditions when sensitisation according to the invention was employed.

What is claimed is:

1. A colour photographic material comprising a transparent support, at least one blue-sensitive, predominantly yellow-coupling silver halide emulsion layer, at least one green-sensitive, predominantly magenta-coupling silver halide emulsion layer (PP-1) and at least one red-sensitive, predominantly cyan-coupling silver halide emulsion layer (BG-1), wherein the spectral sensitivity distribution of BG-1 is characterized in that $$605 \leqq \lambda_{max} \leqq 630 \text{ nm},$$

$$0.1 \leqq \Delta \lg E_{640} \leqq 0.6 \text{ and}$$

$$1.8 \leqq \Delta \lg E_{680},$$

wherein $\lambda_{max}$ represents the wavelength at which the maximum sensitivity occurs, $\Delta \lg E_{640}$ represents the difference of the logarithmic sensitivity at $\lambda_{max}$ minus the logarithmic sensitivity at 640 nm, and $\Delta \lg E_{680}$ represents the difference of the logarithmic sensitivity at $\lambda_{max}$ minus the logarithmic sensitivity at 680 nm, and the sensitivities are determined after exposure and processing of the material at a cyan colour density which is formed by coupling with developer oxidation product and which is 0.5 above the minimum density.

2. The colour photographic material according to claim 1, wherein $610 \leqq \lambda_{max} \leqq 625$ nm, $0.2 \leqq \Delta \lg E_{640} \leqq 0.5$ and $2.0 \leqq \Delta \lg E_{680}$.

3. The colour photographic material according to claim 1, wherein said PP-1 is further from the support than is said BG-1, and at least one green-absorbing dye is contained in BG-1 or in a layer which is situated between said PP-1 and said BG-1.

4. The colour photographic material according to claim 3, wherein the at least one green-absorbing dye is contained in a layer which is situated between PP-1 and BG-1.

5. The colour photographic material according to claim 3, wherein the at least one green-absorbing dye is an aluminium-coloured lake of aurinetricarboxylic acid.

6. The colour photographic material according to claim 1, wherein at least one dye of formula I and at least one dye of formula II are contained in BG-1:

(I)

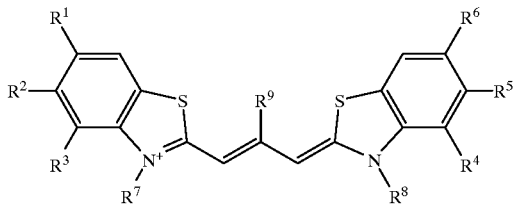

$M^1$ wherein the radicals $R^1$ to $R^6$ are identical or different and are hydrogen, a halogen, a cyano, methyl, trifluoromethyl, methoxy, aryl or hetaryl radical, or $R^1$ together with $R^2$, or $R^2$ together with $R^3$ and/or $R^4$ together with $R^5$, or $R^5$ together with $R^6$, are the remaining members of a substituted or unsubstituted condensed-on benzene or naphthalene ring system, and the radicals $R^1$ to $R^6$, which are not part of a ring system, are identical or different and are hydrogen, a halogen, a cyano, methyl, trifluoromethyl, methoxy, aryl or hetaryl radical, $R^7$ and $R^8$ are identical or different and are an alkyl, $Y^1O_3S$-alkylene, $Y^1O_2C$-alkylene, alkylene-$SO_2$—$NY^1$—$SO_2$-alkyl, alkylene-$SO_2$—$NY^1$—CO-alkyl, alkylene-CO—$NY^1$—$SO_2$-alkyl or alkylene-CO—$NY^1$—CO-alky radical, wherein the alkyl and alkylene are optionally further substituted, $Y^1$ is hydrogen or a negative charge, $R^9$ is hydrogen, a methyl or ethyl radical, and $M^1$ optionally is a counterion for charge compensation, and (II)

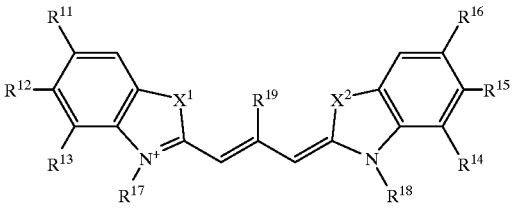

$M^2$ wherein $X^1$ is sulphur or selenium, $X^2$ is oxygen or $R^{10}$ is an alkyl, $Y^1O_3S$-alkylene or $Y^1O_2C$-alkylene, wherein the alkyl and alkylene is optionally further substituted and comprise 1 to 6 C atoms, the radicals $R^{11}$ to $R^{16}$ are identical or different and are hydrogen, a halogen, a cyano, methyl, trifluoromethyl, methoxy, aryl or hetaryl radical, or $R^{11}$ together with $R^{12}$, or $R^{12}$ together with $R^{13}$ and/or $R^{14}$ together with $R^{15}$, or $R^{15}$n together with $R^{16}$, are the remaining members of a substituted or unsubstituted condensed-on benzene or naphthalene ring system and the radicals $R^{11}$ to $R^{16}$, which are not part of a ring system, are identical or different and are hydrogen, a halogen, or a cyano, methyl, trifluoromethyl, methoxy, aryl or hetaryl radical, $R^{17}$ are $R^{18}$ are identical or different and are an alkyl, $Y^1O_3S$-alkylene, $Y^1O_2C$-alkylene, alkylene-$SO_2$—$NY^1$—$SO_2$-alkyl, alkylene-$SO_2$—$NY^1$—CO-alkyl, alkylene-CO—$NY^1$—$SO_2$-alkyl or alkylene-CO—$NY^1$—CO-alky radical, wherein the alkyl and alkylene can be further substituted, $R^{19}$ is hydrogen or a methyl or ethyl radical, and $M^2$ optionally denotes a counterion for charge compensation.

7. The colour photographic material according to claim 6, wherein the alkyl and alkylene groups of $R^7$, $R^8$, $R^{17}$ and $R^{18}$ contain 1 to 6 C atoms.

8. The colour photographic material according to claim 6, wherein at least one of the substituents $R^1$ to $R^6$ is chlorine.

9. The colour photographic material according to claim 6, wherein $X^1$ is selenium.

10. The colour photographic material according to claim 6, wherein $X^2$ is oxygen.

11. The colour photographic material according to claim 7, wherein $X^1$ is selenium, $X^2$ is oxygen and at least one of the substituents $R^1$ to $R^6$ is chlorine.

12. The colour photographic material according to claim 6, wherein $R^{12}$ together with $R^{13}$ are the remaining members of a substituted or unsubstituted condensed-on benzene ring system, and $R^{11}$ is hydrogen and/or $R^{14}$ together with $R^{15}$ is the remaining members of a substituted or unsubstituted condensed-on benzene ring system, and $R^{16}$ is hydrogen.

13. The colour photographic material according to claim 6, wherein $R^{15}$ is chlorine, cyano, methyl, trifluoromethyl, phenyl, thienyl, benzthienyl or pyrrolyl, and $R^{16}$ is H, chlorine or methyl.

14. The colour photographic material according to claim 6, wherein $R^{11}$ is H, methyl or methoxy and $R^{12}$ is chlorine, methyl or methoxy.

15. The colour photographic material according to claim 1, wherein said BG-1 contains at least one silver bromide-iodide emulsion or silver bromide-chloride-iodide emulsion with an iodide content of 0.5 to 40 mol % and a chloride content of 0 to 10 mol %, at least 50% of which with respect to the projected area consists of tabular grains with an aspect ratio of at least 4.

16. The colour photographic material according to claim 15, wherein the tabular grains have a structured arrangement comprising a core, an inner zone and an outer zone, and the inner zone contains at least one iodide-rich crystal zone with an iodide content of 2 to 45 mol %, which with respect to the silver makes up 10 to 70 mol % of the crystals, and which has a higher iodide content than the core and the outer zone.

17. The colour photographic material according to claim 1, wherein the material contains at least two blue-sensitive, predominantly yellow-coupling silver halide emulsion layers, at least two green-sensitive, predominantly magenta-coupling silver halide emulsion layers (PP-1 and PP-2) and at least two red-sensitive, predominantly cyan-coupling silver halide emulsion layers (BG-1 and BG-2) each of which has a different sensitivity, and that the spectral sensitivity distribution of BG-2 is also characterized in that $$605 \leqq \lambda_{max} \leqq 630 \text{ nm},$$

$$0.1 \leqq \Delta \lg E_{640} \leqq 0.6 \text{ and}$$

$$1.8 \leqq \Delta \lg E_{680}.$$

18. The colour photographic material according to claim 17, wherein the material contains at least three green-sensitive, predominantly magenta-coupling silver halide emulsion layers (PP-1, PP-2 and PP-3) and at least three red-sensitive, predominantly cyan-coupling silver halide emulsion layers (BG-1, BG-2 and BG-3), each with a different sensitivity, and that the spectral sensitivity distribution of BG-3 is also characterized in that $$605 \leqq \lambda_{max} \leqq 630 \text{ nm},$$

$$0.1 \leqq \Delta \lg E_{640} \leqq 0.6 \text{ and}$$

$$1.8 \leqq \Delta \lg E_{680}.$$

* * * * *

UNITED STATES PATENT AND TRADEMARK OFFICE

CERTIFICATE OF CORRECTION

PATENT NO. : 6,562,557 B2
DATED : May 13, 2003
INVENTOR(S) : Klaus Wagner et al.

It is certified that error appears in the above-identified patent and that said Letters Patent is hereby corrected as shown below:

Column 30,
Line 4, after "$X^2$ is oxygen or" insert -- $N\text{-}R^{10}$ --.

Signed and Sealed this

Ninth Day of September, 2003

JAMES E. ROGAN
*Director of the United States Patent and Trademark Office*